United States Patent [19]

Campbell

[11] Patent Number: 4,733,412

[45] Date of Patent: Mar. 29, 1988

[54] INSULATED SKI GLOVE

[76] Inventor: William O. Campbell, 286 Stanaford Rd., Winston-Salem, N.C. 27104

[21] Appl. No.: 53,121

[22] Filed: May 22, 1987

[51] Int. Cl.[4] ..... A41D 19/00

[52] U.S. Cl. ..... 2/161 A; 2/164; 2/162

[58] Field of Search ..... 2/161 A, 159, 161 R, 2/162, 167, 164, 158, 272

[56] References Cited

U.S. PATENT DOCUMENTS

| | | | |
|---|---|---|---|
| 1,735,676 | 11/1929 | Elsey | 2/158 |
| 2,314,922 | 3/1943 | Chanut | 2/159 |
| 2,603,790 | 7/1952 | Boehm-Myro | 2/158 |
| 3,114,915 | 12/1963 | Gross | 2/158 |
| 4,081,864 | 4/1978 | Liman | 2/161 A |
| 4,583,248 | 4/1986 | Edwards et al. | 2/164 |
| 4,587,672 | 5/1986 | Madnick et al. | 2/159 |
| 4,662,006 | 5/1987 | Ross | 2/158 |

FOREIGN PATENT DOCUMENTS

| | | | |
|---|---|---|---|
| 91995 | 7/1968 | France | 2/161 R |
| 2444414 | 8/1980 | France | 2/161 R |
| 534846 | 3/1941 | United Kingdom | 2/158 |

*Primary Examiner*—Ronald Feldbaum

*Attorney, Agent, or Firm*—Bell, Seltzer, Park & Gibson

[57] ABSTRACT

The present ski glove provides warmth and is constructed to be highly flexible to permit the wearer to firmly grip and feel the ski pole when skiing. The ski glove includes an inner glove member and an outer glove member with insulating material between the inner and outer glove members and an auxiliary cuff member is formed around the wrist area of the inner glove member by an outwardly folded layer of the inner glove member to provide an outwardly extending wrist encircling welt. The auxiliary cuff is joined at its inner end to a main cuff portion which may be maintained in a position extending partially up the arm of the wearer or which may be turned inwardly over the outer portion of the glove when skiing in warmer temperatures.

11 Claims, 9 Drawing Figures

INSULATED SKI GLOVE

FIELD OF THE INVENTION

This invention relates generally to an insulated ski glove and more particularly to an insulated ski glove which is constructed to coordinate with the skier's clothing and equipment and to provide warmth while being highly flexible to permit the skier to firmly grip and feel the ski pole when skiing.

BACKGROUND OF THE INVENTION

A large majority of the ski gloves presently available include a knitted elastic cuff extending around the outer hand receiving end opening and closely encircling the skier's wrist. This knitted cuff is provided to seal out the cold air from the wearer's hand and to maintain the body heat from the hand inside of the glove. The snug fitting cuff resiliently engages the wrist and moves little, if at all, along the skier's wrist. The normal arm movement during skiing stretches and flexes the sleeve of the skier's jacket so that the cuff of the jacket moves back and forth longitudinally along the skier's wrist relative to the cuff of the skier's glove and exposes the skier's upper wrist and lower arm to the cold outside temperature, and this is an aggravating condition tending to distract the skier's attention from his concentration on skiing.

U.S. Pat. No. 4,583,248 discloses an insulated ski glove provided with an elastic cuff extending around the outer end opening of the glove and being fairly typical of the ski gloves presently available. The glove of this patent is also provided with an inner liner and an outer glove member with an insulation layer of closed-cell foam positioned between the inner and outer glove elements to provide a thermal barrier and retard heat transfer through the glove. However, this type of insulated construction makes the glove rather thick and bulky so that the skier is not able to obtain the desired feel of the ski pole when skiing.

U.S. Pat. No. 1,488,133 discloses a glove which includes an outer glove layer and an inner glove lining with an extended cuff or gauntlet portion extending above the wrist and with an elastic wrist portion on the inner lining to snugly fit around the wrist of the wearer and to prevent the entry of cold air into the hand portion of the glove. However, this elastic wrist portion on the inner liner does not extend outwardly and form a wrist encircling welt with an encircling pocket so that it is possible that snow entering the outer flared main cuff or gauntlet can melt and run into the hand portion of the glove. Also, the construction of this glove makes it difficult to turn down the outer main cuff when skiing in warm weather conditions.

SUMMARY OF THE INVENTION

In contrast to the above-described prior art, it is an object of the present invention to provide an insulated ski glove which overcomes the problems of the prior art and provides warmth while being highly flexible to permit the wearer to firmly grip and feel the ski pole and to provide a heat seal with the sleeve of the ski jacket during extremely cold weather while permitting the outer cuff or main cuff to be turned down during warmer weather conditions.

In accordance with the present invention, the ski glove includes a hand-encasing inner glove member with finger and thumb stalls, a palm, a back, and a main cuff portion with an outer end opening extending beyond the wrist area of the wearer. A hand-encasing outer glove member conforms to and covers the hand-enclosing inner glove member and includes an outer end opening secured to the outer end opening of the main cuff portion of the hand-enclosing inner glove member to provide an open end to receive the hand of the wearer. An auxiliary cuff member is formed around the wrist area of the hand-encasing inner glove member and is formed by an outwardly folded layer of the hand-enclosing inner glove member to form an outwardly extending wrist encircling welt with a surrounding pocket. An elastic band is secured in the outwardly extending wrist encircling welt and provides a resilient gripping of the auxiliary cuff with the wrist of the wearer so that the main cuff may be turned outwardly over the palm and around the back of the hand-encasing outer glove while maintaining the resilient gripping engagement of the auxiliary cuff around the wrist of the wearer.

A layer of insulating material is attached to and covers the outer surface of the hand-encasing inner glove member. The layer of insulating material extends outwardly to the auxiliary cuff and is positioned inside of the hand-encasing outer glove member to provide a thermal barrier and yet does not unduly restrict flexibility of the glove when gripping a ski pole. A palm overlay extends across and is attached to the palm of the hand-enclosing outer glove member and provides an anti-slip surface for engagement with the ski pole. The palm overlay includes an outer edge extending across the palm adjacent the thumb and diagonally outwardly to the wrist area and an inner edge extending across and covering the inner end portions of the finger stalls. The outer edge of the palm overlay is secured continuously to the hand-enclosing outer glove member and the medial portion of the inner edge of the palm overlay is free of attachment to the inner end portions of the middle finger stalls to provide freedom of movement to these finger stalls.

The present ski glove also includes anti-slip strips secured to and extending along the inner surface of the thumb and the index finger and these strips cooperate with the palm overlay to aid in gripping engagement with the ski pole. The juncture of the palm, back and main cuff of the side of the hand-enclosing outer glove member adjacent the thumb stall defines a substantially straight line while the juncture of the opposite side of the hand-enclosing outer glove member is curved outwardly in the area of the main cuff portion to provide freedom of pivotal movement of the wrist during skiing. Velcro fasteners are provided in the outwardly flared main cuff and at one side to vary the size of the opening at the outer end of the glove and surrounding the sleeve of the ski jacket.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 7:
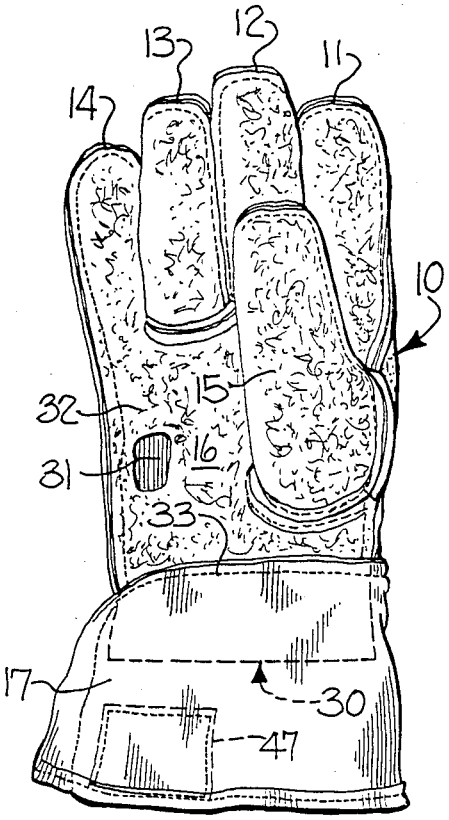
FIG. 7 is an elevational view of the hand-encasing inner glove member, looking at the palm side thereof and before it is inserted in the hand-encasing outer glove member.

The insulated ski glove of the present invention includes a hand-encasing inner glove member, broadly indicated at 10 in FIG. 7, and including finger stalls 11–14 and a thumb stall 15. The inner glove member also includes a palm 16 and a main cuff portion 17 with an outer end opening extending outwardly beyond the wrist area of the wearer.

Figure 8:
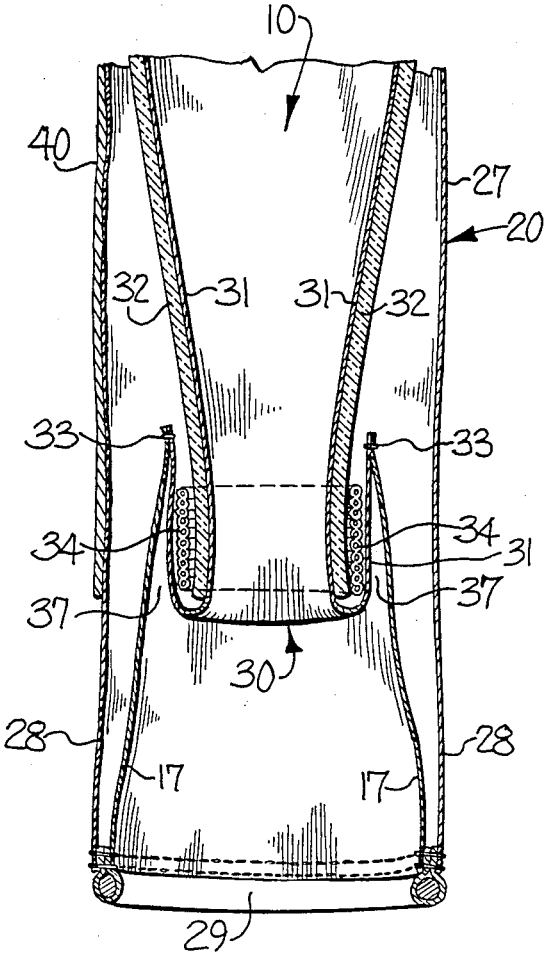
FIG. 8 is an enlarged, somewhat schematic, sectional view taken substantially along the line 8—8 in FIG. 4.

A hand-encasing outer glove member, broadly indicated at 20, conforms to and covers the hand-encasing inner glove member 10 and includes finger stalls 21–24 (FIG. 3) and a thumb stall 25. The outer glove member 20 is preferably woven of nylon yarn and also includes a palm 26, a back 27, and a main cuff portion 28 with an outer end opening secured to the outer end opening of the main cuff portion 17 of the hand-encasing inner glove member 10 to provide an open end to receive the hand of the wearer. As shown in FIG. 8, the main cuff portions 17 and 28 are stitched together and stitched to a bead cord 29.

An auxiliary cuff member, broadly indicated at 30, is formed around the wrist area of the hand-encasing inner glove member 10. The inner glove member 10 is preferably formed of an inner layer of knit nylon yarn, as indicated at 31 in FIG. 8, and insulation material, such as Thinsulate, indicated at 32, covers the finger stalls 11–14 and the thumb stall 15 and extends upwardly into the auxiliary cuff 30. The inner surface of the knit nylon inner layer 31 is preferably brushed to provide a soft surface against the hand of the wearer. As shown in FIG. 8, the cuff 30 is formed by folding the inner layer 31 over and outwardly to provide an outwardly extending wrist encircling welt. The inner end of the main cuff portion 17 of the inner glove member 10 is attached to the folded over end of the knit inner layer 31 and stitched thereto, as indicated at 33 in FIG. 8.

Elastic band means, in the form of an elastic tape 34 (FIG. 8), is secured by spaced-apart rows of stitching 35 (FIGS. 5 and 6) extending through the outwardly extending wrist encircling welt forming the auxiliary cuff 30. The elastic tape 34 provides a resilient gripping of the auxiliary cuff 30 with the wrist of the wearer and permits the main cuff to be turned inwardly over the palm 26 and the back 27, as illustrated in FIGS. 5 and 6, while maintaining the resilient gripping engagement of the auxiliary cuff 30 around the wrist of the wearer.

Figure 1:
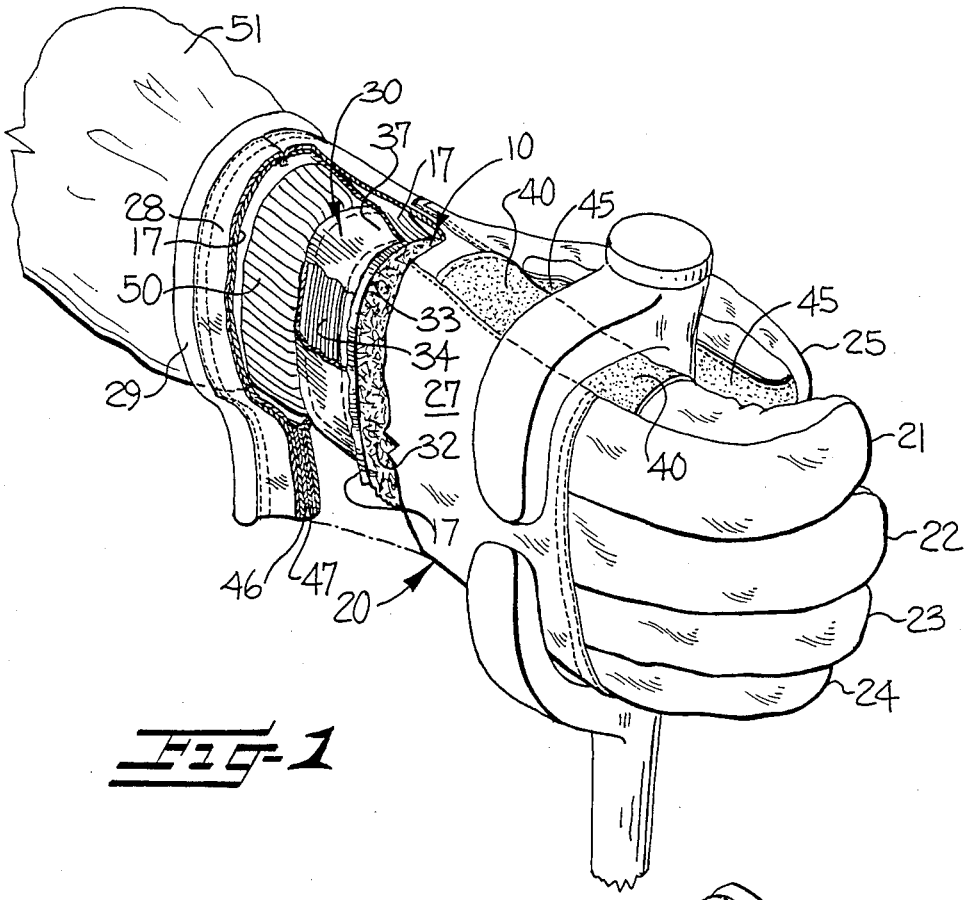
FIG. 1 is a perspective view of the ski glove of the present invention illustrated on the hand of a wearer and with the hand gripping a ski pole, portions of the outer cuff being broken away to illustrate the manner in which the auxiliary cuff snugly encircles the wrist of the wearer.

The outwardly extending wrist encircling welt forming the auxiliary cuff 30 is surrounded by a circular pocket, indicated at 37 in FIG. 8, which acts as a barrier or a trap to prevent snow and the like, which might enter the open end of the main cuff, from being in direct contact with the wrist of the wearer. The circular pocket 37 also allows the wearer to reach in and grasp the auxiliary cuff 30 to assist with donning the glove. When the present ski glove is positioned on the hand of the wearer, as illustrated in FIG. 1, the auxiliary cuff 30 resiliently engages and surrounds the wrist of the wearer and is positioned in mating aligned relationship with an elastic cuff 50 of the sleeve 51 of the ski jacket being worn by the skier. The main cuffs 17, 28 of the inner and outer glove members 10, 20 surround the lower end portion of the sleeve 51 of the ski jacket so that if any snow or the like is deposited in the main cuffs 17, 28, it will be trapped in the pocket 37 surrounding the auxiliary cuff 30 so that it will not come into contact with the wrist and hand of the wearer.

Figure 2:
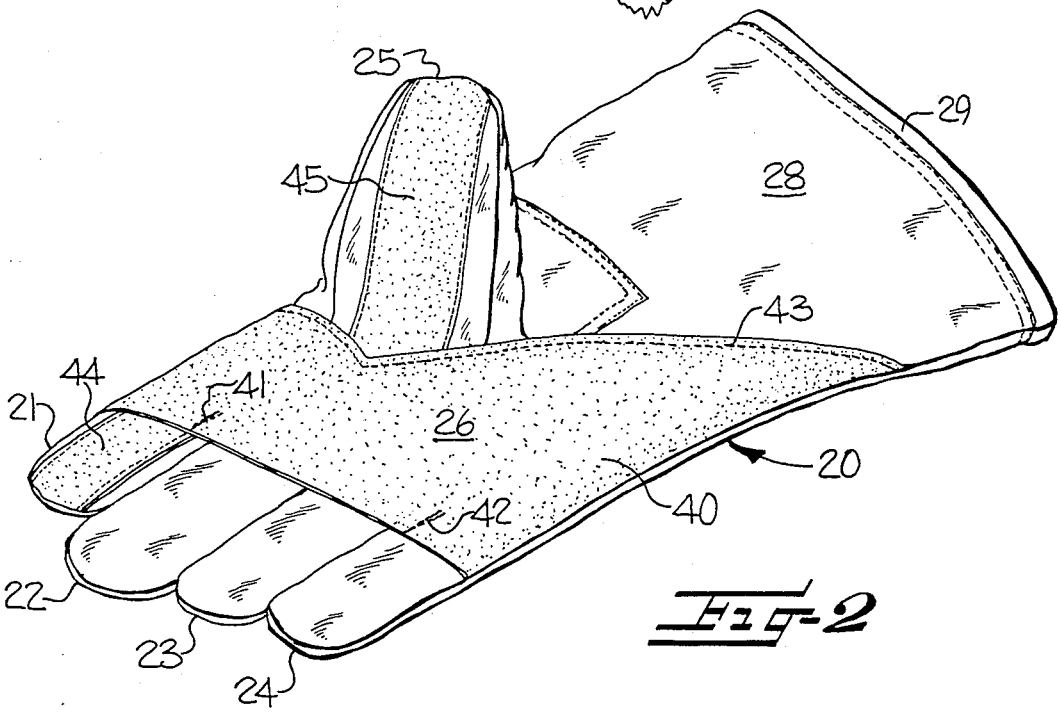
FIG. 2 is a perspective view looking at the inner palm side of the present glove, with the thumb being raised upwardly to illustrate the manner in which the palm overlay extends across the inner palm of the glove and the anti-slip strips are attached to the thumb and index fingers on the inside thereof.
Figure 5:
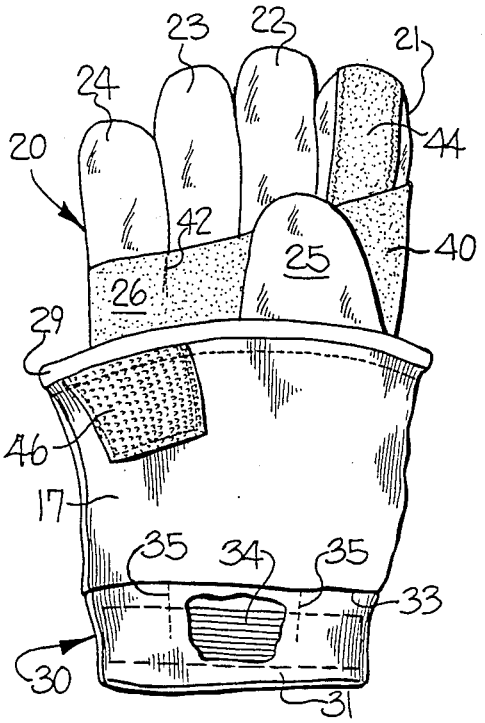
FIG. 5 is a view similar to FIG. 3 but illustrating the main cuff being turned down over a portion of the palm of the glove and exposing the auxiliary wrist engaging cuff.
Figure 6:
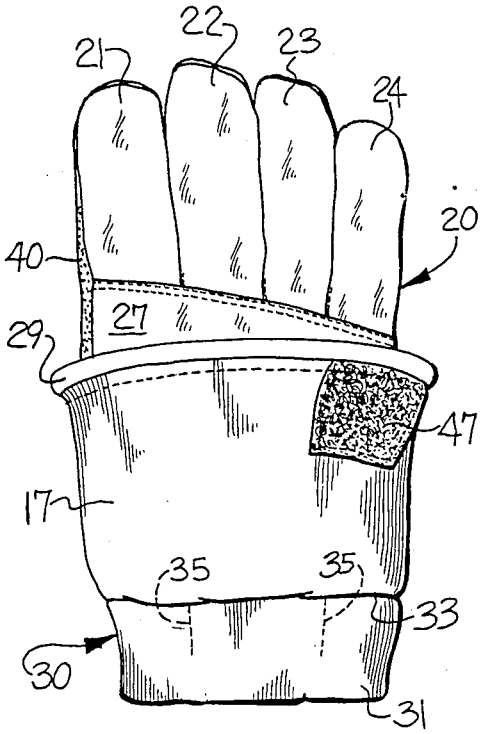
FIG. 6 is a view similar to FIG. 5 but looking at the opposite or back side of the glove with the main cuff turned downwardly.
Figure 9:
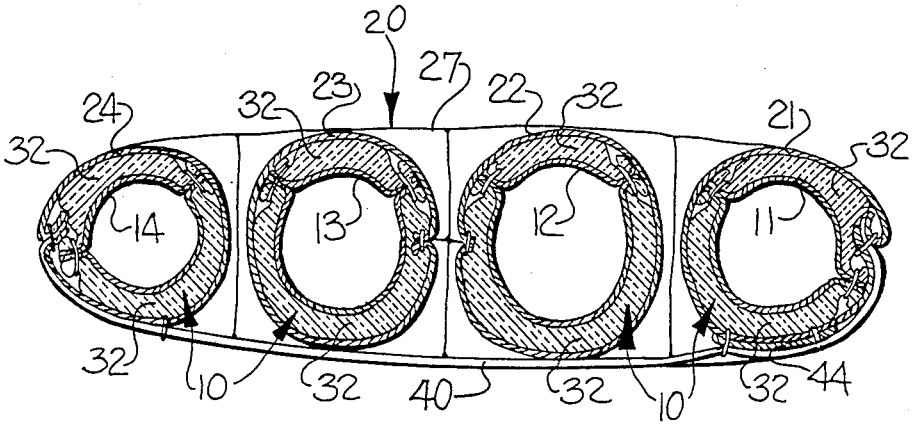
FIG. 9 is an enlarged sectional view through the finger stalls, being taken substantially along the line 9—9 in FIG. 3.

Also, when skiing in warmer temperatures, the auxiliary cuff member 30, being formed by the outwardly folded layer of the hand-encasing inner glove member 10 and the elastic tape 34, permits the main cuffs 17 and 28 to be turned inwardly and over the palm 26 and the back 27 of the outer glove member 10, as illustrated in FIGS. 5 and 6, to maintain the resilient gripping engagement of the auxiliary cuff 30 around the wrist of the wearer. As illustrated in FIGS. 2 and 9, the finger stalls of the hand-enclosing outer glove member 20 are formed of a single piece construction and include a seam closure extending around the outer ends and along one side of each of the finger stalls 21–24.

A palm overlay 40 extends across and is attached to the palm area 26 of the outer glove member 20 and includes a forward or inner edge extending across the inner portions of the finger stalls 21–24. The palm overlay 40 is preferably formed of glove leather and the inner edge is free of attachment to the inner end portions, of the middle finger stalls 22, 23 to provide freedom of movement to the middle finger stalls. Opposite side portions of the palm overlay 40 are attached to the index finger 21 as by a row of stitching 41 and to the little finger 24, as by a row of stitching 42 (FIG. 2). The palm overlay 40 includes an outer edge extending across the palm and adjacent the thumb 25 and then extending diagonally outwardly to the outer edge of the main cuff 28, as illustrated in FIG. 2. The outer edge of the palm overlay 40 is continuously attached to the outer glove member 20 by a row of stitching 43.

The palm overlay 40 provides an anti-slip surface on the inner portion of the glove for engagement with the ski pole. An anti-slip strip 44 of glove leather is stitched to the inner surface of the index finger 21 and another anti-slip strip 45 of glove leather is stitched to the inner surface of the thumb 25 to further aid in gripping engagement of the ski pole. If desired, the anti-slip strips 44, 45 may be of the same width and completely cover the respective index finger 21 and thumb 25.

Figure 3:
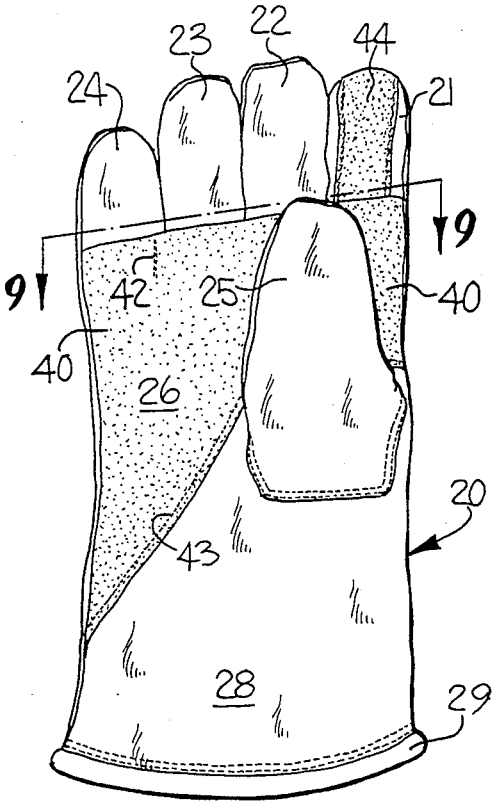
FIG. 3 is an elevational view looking at the inside of the glove of the present invention.
Figure 4:
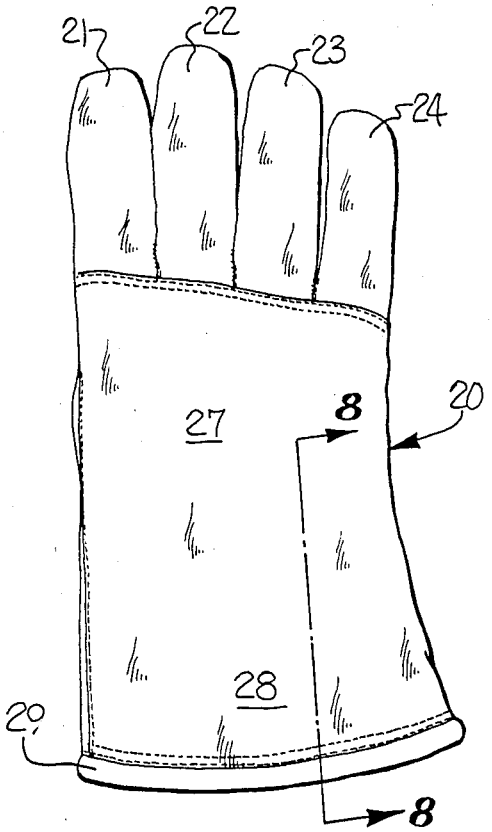
FIG. 4 is a view similar to FIG. 3 but looking at the outside or back of the glove.

As best illustrated in FIGS. 3 and 4, the juncture of the palm 26, back 27 and main cuff 28 of the side of the outer glove member 20 adjacent the thumb stall 25 defines a substantially straight line while the opposite side of the outer glove member 20 is curved outwardly, particularly in the area of the palm and the main cuff 28 to provide freedom of pivotal movement of the wrist. This curved outer side edge of the outer glove member 20 provides an outwardly flaring main cuff 28 and a conforming outwardly flaring configuration of the main cuff 17 of the inner glove member 10 and provides a relatively large hand-receiving opening encircling the lower end of the sleeve of the ski jacket, as illustrated in FIG. 1.

In order to close or reduce the size of this rather large opening, after the ski glove is in position on the hand of the wearer, fastening means is provided on one side of the inside of the main cuff 17 and adjacent the outwardly curved area. This fastening means is illustrated in the form of patches of male and female Velcro, respectively indicated at 46, 47 in FIGS. 5 and 6, which are sewn to the inner surface of the main cuff 17 of the inner glove member 10. When the glove is positioned on the hand, the outer curved portion of the main cuff may be pressed together to attach the Velcro patches 46, 47 to each other and thereby close or reduce the size of the opening surrounding the sleeve of the ski jacket.

The present insulated ski glove provides warmth and is sufficiently flexible to permit the wearer to firmly grip and feel the ski pole and includes a main cuff portion adapted to extend upwardly along the arm of the wearer with an auxiliary cuff member formed around the wrist area of the hand-encasing inner glove member. In order to further aid in excluding moisture from penetrating the glove, a liner of film material, such as a material commercially available under the trademark "Gore-Tex," may be inserted between the inner and outer glove members. This particular type of material prevents entry of moisture from the outside of the glove but allows escape of vapor caused by perspiration. An elastic band is enclosed in the outwardly extending wrist encircling welt of the auxiliary cuff to provide a resilient gripping of the auxiliary cuff around the wrist of the wearer and to provide an encircling protecting pocket area between the connection of the main cuff with the auxiliary cuff so that the main cuff may be turned inwardly over the outer portion of the glove while maintaining the resilient gripping engagement of the auxiliary cuff around the wrist of the wearer.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. An insulated ski glove providing warmth and being highly flexible to permit the wearer to firmly grip and feel the ski pole when skiing, said glove comprising (a) a hand-encasing inner glove member including finger and thumb stalls, a palm, a back, and a main cuff portion with an outer end opening extending beyond the wrist area of the wearer, (b) a hand-encasing outer glove member conforming to and covering said hand-encasing inner glove member and including an outer end opening secured to said outer end opening of said main cuff portion of said hand-encasing inner glove member to provide an open end to receive the hand of the wearer, (c) an auxiliary cuff member formed around the wrist area of said hand-encasing inner glove member, said auxiliary cuff member being formed by an outwardly folded layer of said hand-encasing inner glove member and forming an outwardly extending wrist encircling welt, and (d) elastic band means secured in said outwardly extending wrist encircling welt and providing a resilient gripping of said auxiliary cuff with the wrist of the wearer and permitting said main cuff to be turned inwardly over said palm and around the back of said hand-encasing outer glove member while maintaining the resilient gripping engagement of said auxiliary cuff around the wrist of the wearer.

2. An insulated ski glove according to claim 1 including a layer of insulating material attached to and covering the outer surface of said hand-enclosing inner glove member, said layer of insulation material extending outwardly to said auxiliary cuff and being positioned inside of said hand-encasing outer glove member.

3. An insulated ski glove according to claim 1 wherein said finger stalls of said hand-enclosing outer glove member are formed of a single piece construction, and including seam closure means extending around the outer ends and along one side of each of said finger stalls.

4. An insulated ski glove according to claim 1 including a palm overlay extending across and attached to said palm of said hand-enclosing outer glove member, said palm overlay providing an anti-slip surface for engagement with the ski pole.

5. An insulated ski glove according to claim 4 wherein said palm overlay comprises glove leather.

6. An insulated ski glove according to claim 4 wherein said palm overlay includes an outer edge extending across said palm and adjacent said thumb and diagonally outwardly to said wrist area, and an inner edge extending across and covering the inner end portions of said finger stalls.

7. An insulated ski glove according to claim 6 including seam means continuously securing said outer edge of said palm overlay to said hand-enclosing outer glove member, and wherein said inner edge of said palm overlay is free of attachment to the inner end portions of the middle finger stalls to provide freedom of movement to said middle finger stalls.

8. An insulated ski glove according to claim 7 including anti-slip strips secured to and extending along the inner surface of said thumb and the index finger and cooperating with said palm overlay to aid in gripping engagement of the ski pole.

9. An insulated ski glove according to claim 1 wherein the juncture of said palm, back and main cuff of the side of said hand-enclosing outer glove member adjacent said thumb stall defines a substantially straight line, and wherein the juncture of the opposite side of said hand-enclosing outer glove member is curved outwardly in the area of said main cuff to permit freedom of pivotal movement of the wrist.

10. An insulated ski glove according to claim 9 including Velcro fastening means positioned inside of said main cuff and adjacent said outwardly curved area to permit adjustment of the size of the outer end opening of said ski glove.

11. An insulated ski glove according to claim 1 wherein said hand-enclosing inner glove member is formed of knit synthetic yarn with the inner surface being brushed, and wherein said hand-enclosing outer glove member is formed of woven nylon yarn.

* * * * *